United States Patent [19]

Risko et al.

[11] Patent Number: 4,961,490

[45] Date of Patent: Oct. 9, 1990

[54] TRANSFER MECHANISM WITH JAM DETECTOR

[75] Inventors: Frank D. Risko, Livonia; Thomas D. Lewis, Highland, both of Mich.

[73] Assignee: Elopak Systems A.G., Glattbrugg, Switzerland

[21] Appl. No.: 158,617

[22] Filed: Feb. 22, 1988

Related U.S. Application Data

[63] Continuation-in-part of Ser. No. 851,184, Apr. 14, 1986, abandoned.

[51] Int. Cl.[5] ..... B65G 47/36

[52] U.S. Cl. ..... 198/433; 198/448; 198/468.4; 198/464.2

[58] Field of Search ..... 198/339.1–341, 198/424–426, 428, 429, 431–433, 435, 437, 444, 462.2, 463.3, 464.1–464.4, 468.8, 471.1, 571, 572, 803.5, 448, 468.4; 414/72, 744 B, 737, 752; 901/40; 294/64.1, 907; 53/55–58, 493–500

[56] References Cited

U.S. PATENT DOCUMENTS

| | | | |
|---|---|---|---|
| 3,160,259 | 12/1964 | Dalton | 198/432 X |
| 4,044,891 | 8/1977 | Pynsky | 198/339.1 X |
| 4,059,187 | 11/1977 | Rueff et al. | 198/471.1 X |
| 4,172,347 | 10/1979 | Nitz | 53/493 X |
| 4,183,427 | 1/1980 | Tomikawa | 198/468.4 X |
| 4,199,050 | 4/1980 | Moller | 198/429 |
| 4,559,718 | 12/1985 | Tadokoro | 414/744 X |
| 4,566,251 | 1/1986 | Spisak et al. | 53/426 X |
| 4,590,740 | 5/1986 | Rodocker | 53/426 |

*Primary Examiner*—Robert J. Spar
*Assistant Examiner*—James R. Bidwell
*Attorney, Agent, or Firm*—John P. Moran

[57] ABSTRACT

A mechanism for transferring a pair of side-by-side cartons from one processing station to another, and accompanying device(s) for detecting any jam-up during the transfer, should one occur for any reason. One embodiment includes a photoelectric unit, a vacuum sensor, and a strobe signal for timing and detecting the presence of both signals to shut down the machine if either signal is abnormal. Another embodiment includes a second strobe signal for use as a back-up for the first strobe, or in lieu thereof, for timing and detecting the photoelectric signal only.

3 Claims, 2 Drawing Sheets

TRANSFER MECHANISM WITH JAM DETECTOR

This application is a continuation-in-part application of Ser. No. 851,184 filed April 14, 1986, now abandoned.

Technical Field

This invention relates generally to transfer mechanisms and, more particularly, to means for detecting whether or not the product being handled has actually been transferred.

Background Art

In machines wherein a product, such as a paperboard carton, must be processed through a plurality of internal transfers prior to being filled with a liquid product, in the event of an unsuccessful transfer of some one carton at any of the transfer points oncoming cartons will continue to index and feed into the jammed carton. If undetected, there results an increased load on the indexing devices, which may break or damage machine components.

It is apparent that various mechanical or other type means may be used to determine that a transfer has occurred at a particular transfer point.

Disclosure of the Invention

A general object of the invention is to provide an improved means for detecting a product transfer at a predetermined transfer point.

Another object of the invention is to provide novel electronic means for detecting the transfer of a paperboard carton at a predetermined transfer point in a forming, filling and sealing machine.

A further object of the invention is to provide electronic means coupled with photoelectric and vacuum sensing means for detecting any jam-up of a paperboard carton at a particular transfer point in a packaging machine.

Still another object of the invention is to provide means consisting of a photoelectric sensor, a vacuum sensor, and at least one strobe signal adapted to detect the presence of signals from both sensors.

These and other objects and advantages will become more apparent when reference is made to the following description and accompanying drawings.

Best Mode of Carrying Out the Invention

Figure 1:
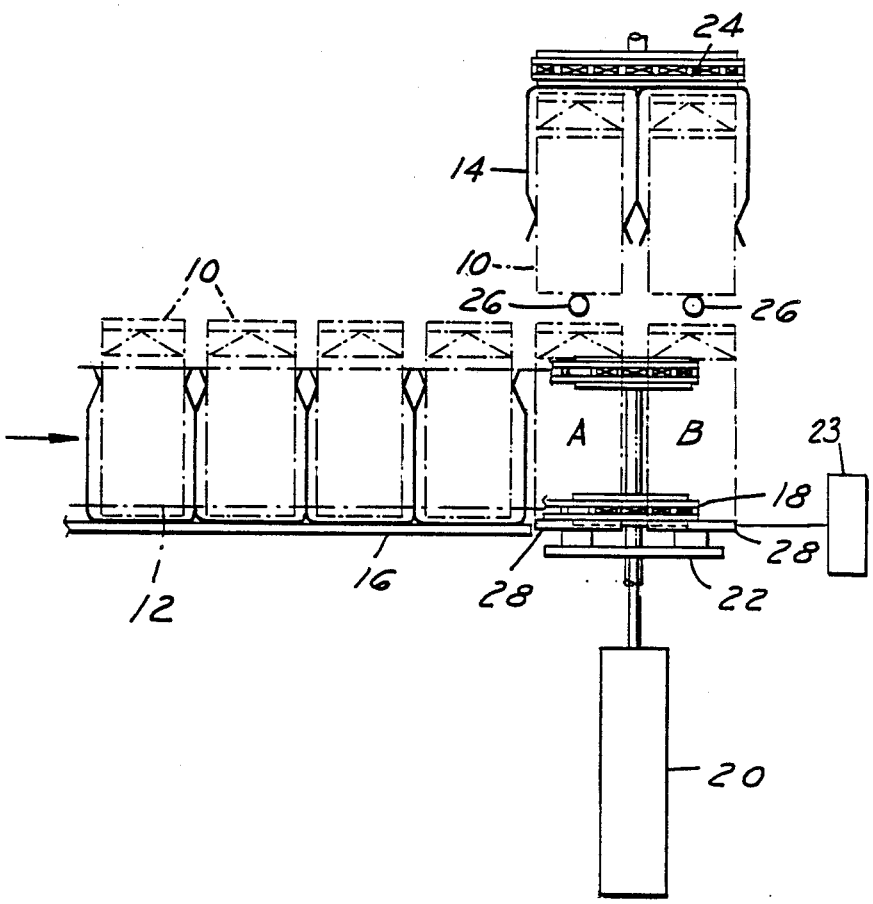
FIG. 1 is a side elevational view of a fragmentary portion of a machine embodying the invention.

Referring now to the drawings in greater detail, FIG. 1 illustrates a loading type of transfer point as may be used to transfer bottom sealed cartons 10 two-at-a-time from an indexing conveyor means 12, moving from left to right in FIG. 1, to resilient carriers 14 moving at a right angle with respect to the conveyor. The conveyor means 12 is driven by a shaft 11 from a machine motor 13 through a conventional speed reducer with indexing plate, represented at 15.

In this instance, the carriers each consist of an inverted U-shaped bracket whose side walls are normally urged toward one another until spread slightly to admit and retain a carton 10 therebetween. To arrive at this point, the cartons 10 typically will have been stripped from a mandrel (not shown) and placed on a stationary rail 16 extending laterally from between a pair of parallel endless conveyors 12 mounted around sprockets 18, as more fully shown and explained in U.S. Pat. No. 4,566,251, issued Jan. 28, 1986.

The transfer of the pair of cartons 10 from the conveyor 12 to the carriers 14 is accomplished by a lifting mechanism 20, having a support platform 22 above which the cartons are positioned as they leave the rail 16. During the dwell period of the indexing cycle of the conveyor, the lifting mechanism 20 extends between the conveyors and raise each two side-by-side cartons vertically upwardly into the spring biased carriers 14.

At this transfer station it is very critical that the carton properly transfer from the conveyors 12 to the carriers 14. Upon successful completion of the transfer, a conveyor 24 associated with the carriers 14 indexes the cartons onto support rails 26 for the start of a further process step, such as the sterilization process. Sensors, represented at 28, are mounted on the support platform 22 and serve to detect an increase in the force necessary to lift the cartons 10 into the carriers 14. This sensor can be a load cell, a strain gauge device, a spring loaded plate and proximity switch, or a similar device that is capable of an instant response to an increase in the force needed to lift the carton. This response or increased force load would be sensed by a conventional control system, represented at 23, and immediately stop the conveyor 24 to prevent further jamming of the carton, damage to the machine, and lost downtime. A carton jammed at this point in the machine can be easily removed without major machine problems. Otherwise, a jam in the machine could cause a compromise of the commercial sterility, and complete machine resterilization may be required, which involves a substantial amount of downtime. The control system 23 is conventional inasmuch as it includes sensors, such as strain gage transducer or load cell connected to a typical amplifier via a relay connection to the usual motor to stop the machine.

Figure 2:
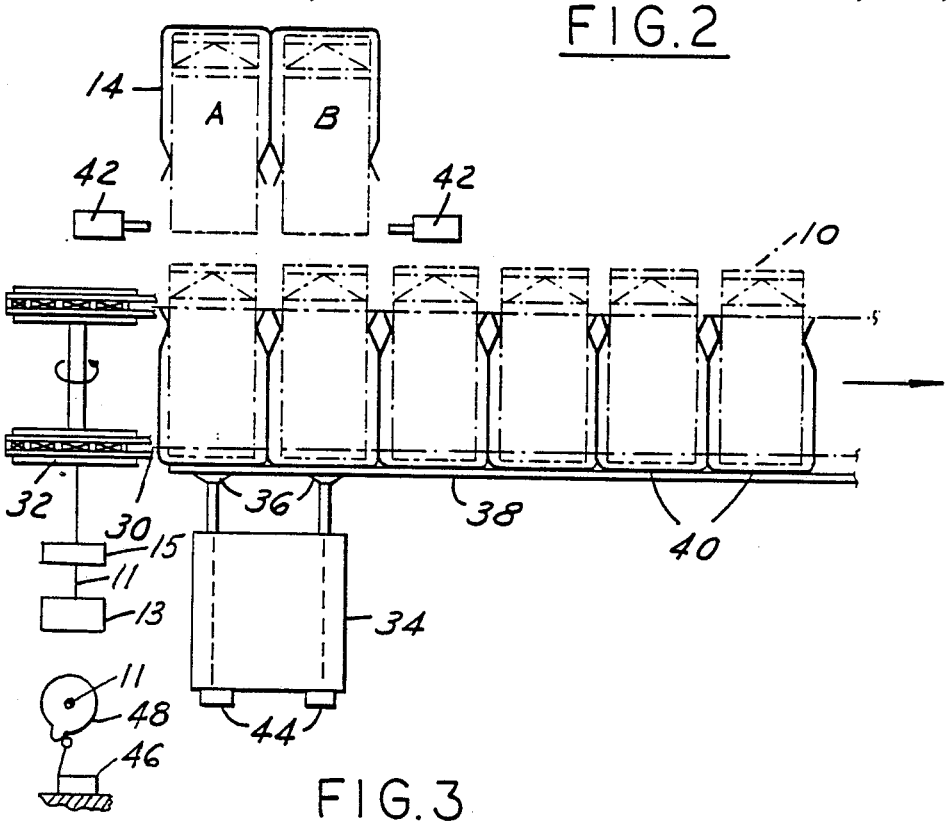
FIG. 2 is a side elevational view of a second fragmentary portion of the machine embodying the invention.

Referring now to FIG. 2, once a process, such as a sterilization process has been completed, it becomes necessary to transfer the now sterilized cartons 10 back between another pair of parallel endless indexing conveyors 30 mounted around sprockets 32 to be transported through a filling station and a top sealing station prior to discharge. At this unloading transfer point each pair of cartons 10 will have been carried from a direction toward the reader, or out of the paper, to be transferred to the conveyors 30 moving from left to right in FIG. 2.

An unloading device 34 serves to raise a pair of vacuum cups 36 upwardly to engage the pair of cartons 10 being held in the carriers 14. The vacuum cups engage the bottoms of the cartons and pull them down onto a stationary rail 38 and into compartments 40 between the conveyors 30 which will be indexed for the further processing of final filling and sealing of the cartons.

A pair of retroreflective photoelectric sensors 42, such as those available from Banner Engineering Corporation, Minneapolis, Minnesota, will detect the presence of two cartons as the latter move into the unload station. In such an arrangement, the cartons in rows A and B (FIG. 2) reflect back to the respective oppositely disposed photoelectric sensors 42. This fact is recorded and stored in the logic system of the machine control unit. The vacuum cups 36 are operatively connected to vacuum sensors 44, which serve to detect the increase in vacuum after the unloading device has raised the cups 36 to grip the bottoms of the cartons. This event is also noted in the machine control unit, and as the unloading device 34 is cycled and the two cartons are pulled into the conveyor compartments 40, a comparison is made of the signals to determine if cartons that were sensed in the carriers 14 had successfully passed by the photoelectric sensors 42, and had been subjected to sufficient vacuum, as sensed by the vacuum sensors 44, to be pulled into receiving compartments 40. If both signals are not correct within a predetermined time period, the machine control system will be caused to stop, thereby preventing jamming of the cartons at this transfer station.

Figure 3:
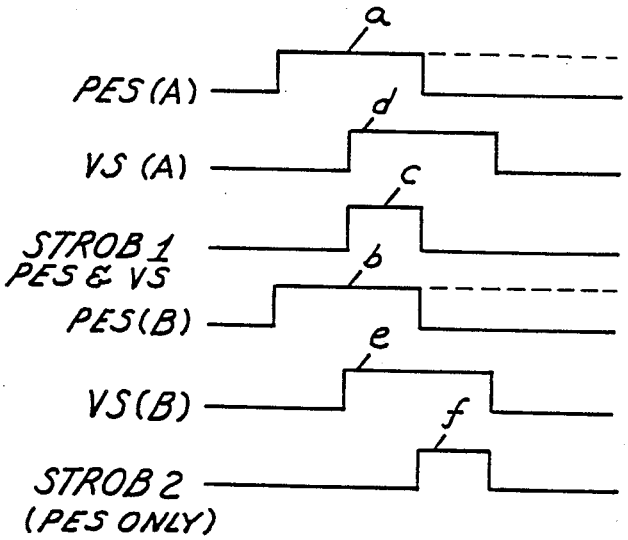
FIG. 3 is a graphic representation or chart of the timing operation of the FIG. 2 structure.

FIG. 3 shows the logic and timing of the photoelectric sensor 42 (PES) and the vacuum sensor 44 (VS), a first strobe signal that is used to detect the presence of both signals, and a second strobe signal that is used to detect the presence of only the PES signal, all interconnected in conventional logic circuitry. A number of conditions will cause the machine to be stopped:

1. If the PES signal a or b for either carton 10 is lost after being detected prior to the beginning of the first strobe signal c, the machine will be stopped.
2. If the PES signal a or b is lost for either carton 10 after being detected prior to the end of the first strobe signal c, the machine will be stopped.
3. If the PES signal a or b is detected and no VS signal d or e is detected for either carton 10, the machine will be stopped.
4. If the PES signal a or b is detected and the VS signal d or e is lost for either carton 10 prior to the end of the first strobe signal c, the machine will be stopped.
5. If no PES signal a or b is detected, the VS signal d or e will be ignored and the machine will not be stopped.

The strobe signals are unrelated to the PES or the VS signals, and are developed from other timing signals in the machine and synchronized to the conveyor movements. More specifically, referring to FIG. 3, the beginning of the strobe c signal is caused to be substantially coincident with the beginning of the VS d signal, and the ending of the strobe c signal is caused to be substantially coincident with the ending of the PES a signal. The strobe signal c is an independent signal and may be generated by a commercially available limit switch 46 (FIG. 2) in contact with a cam 48 which is timed to the indexing of the conveyor 30 so that it occurs once per revolution of the shaft 11, which equates to one index of the machine. This signal c is fed into the conventional control system 23 for the purposes herein described.

The second strobe signal f is optional and may be used either to back up the action of the first strobe signal c, or in lieu thereof. This second strobe signal f, which is developed in the same manner as the signal c, serves to detect that the PES signals a and b have shown that both cartons 10 have been removed, i.e., moved completely past the photoelectric sensors 42 and, hence, have been deposited in the compartments 40 of the conveyors 30. Should any one carton not pass by the photoelectric unit, the pulse would continue as represented by the dash lines in FIG. 3.

Industrial Applicability

It should be apparent that the invention provides a novel and efficient means for assuring that transfers of a product, such as paperboard cartons, have occurred at the inlet and outlet of crucial processing operations, such as a sterilization chamber, wherein jam-ups would cause substantial downtime, not only in unjamming and possible machine damage, but in complete resterilization time before the machine can be restarted.

While but two embodiments have been shown and described, other modifications are possible within the scope of the following claims.

The embodiments of the invention in which an exclusive property or privilege is claimed are defined as follows:

1. A transfer mechanism comprising vacuum actuated transfer means including means for utilizing vacuum for engaging and transferring at least one carton from one processing unit to an indexing conveyor, photoelectric means for detecting the presence of said at least one carton in said one processing unit, vacuum sensors operatively connected to said transfer means for detecting the increase in vacuum once the transfer means has engaged said at least one carton, and strobe means for producing a signal which occurs concurrently with the vacuum sensor's detection of the increase in vacuum, and ends when the photoelectric means detects the absence of said at least one carton, and otherwise serving to note whether either of the cooperating photoelectric and vacuum sensing signals is detected and then lost or is not detected prior to the end of the strobe signal, to thereby stop the transfer mechanism should either occur;

and a control system including conventional logic circuitry adapted to receive inputs from said photoelectric means and said vacuum sensors, wherein said strobe means includes a shaft operatively connected to said indexing conveyor and adapted to rotate once for each index of the conveyor, a cam mounted on said shaft for rotation therewith, and a limit switch operatively connected to said cam for signalling said conventional logic circuitry so as to stop said transfer mechanism in the event either of said inputs is not detected.

2. The transfer mechanism described in claim 1, wherein the strobe signal serves to detect that the photoelectric signals have shown that said at least one carton has moved therepast from said processing unit to said indexing conveyor.

3. The transfer mechanism described in claim 1 adapted to two side-by-side cartons, and a second strobe signal, wherein said second strobe signal backs up the action of said first-mentioned strobe signal by detecting that the photoelectric signals have shown that at least one carton has been removed from said one processing unit and deposited in said indexing conveyor.

* * * * *